US007244952B2

(12) United States Patent
Mous

(10) Patent No.: US 7,244,952 B2
(45) Date of Patent: Jul. 17, 2007

(54) COMBINATIONS OF DEFLECTION CHOPPING SYSTEMS FOR MINIMIZING ENERGY SPREADS

(75) Inventor: Dirk J. W. Mous, Nieuwegein (NL)

(73) Assignee: High Voltage Engineering Europa B.V. (NL)

( * ) Notice: Subject to any disclaimer, the term of this patent is extended or adjusted under 35 U.S.C. 154(b) by 0 days.

(21) Appl. No.: 10/873,391

(22) Filed: Jun. 22, 2004

(65) Prior Publication Data

US 2005/0017195 A1 Jan. 27, 2005

Related U.S. Application Data

(60) Provisional application No. 60/480,862, filed on Jun. 24, 2003.

(51) Int. Cl.
*H01J 49/44* (2006.01)

(52) U.S. Cl. ..... 250/492.21; 250/397

(58) Field of Classification Search ..... 250/396 R, 250/400

See application file for complete search history.

(56) References Cited

U.S. PATENT DOCUMENTS 4,912,327 A * 3/1990 Waugh ..... 250/309

OTHER PUBLICATIONS

Nuclear Instruments and Methods 159 (1979) 245-263; F.J. Lynch et al.; "Beam Buncher For Heavy Ions*".

Fast Neutron Physics, vol. 1, p. 509-621; (Interscience Publishers 1960); J.H. Neiler et al.; "Time of Flight Techniques".

Oak Ridge National Laboratory, TN 1981;Third International Conference on Electrostatic Accelerator Technology by S.J. Skorka; pp. 130-138; "Design Considerations and Present Status of Beam Bunching Technology".

* cited by examiner

*Primary Examiner*—David A. Vanore
(74) *Attorney, Agent, or Firm*—Nields & Lemack

(57) ABSTRACT

Pulsed MeV ion beam techniques are broadly applied in time-of-flight experiments for direct measurements of neutron velocities and energies. They are also used to achieve a neutron monochromater by allowing the selection of neutrons having a well defined velocity. The sequence of components needed for creation of sub-nanosecond pulsed MeV ion beam systems usually consist of a suitable DC ion source, a chopper module for production of beam pulses, a klystron buncher for introducing time compression to individual pulses and a final ion-acceleration stage. It is pointed out that the achievable pulse compression is limited by the energy spread within the pulses that are directed into the klystron buncher. Furthermore, that this energy spread may be dominated by the energy spread created within the preceding chopper system. The present invention minimizes this problem of chopper introduced energy spreads and discloses a chopping system that comprises at least two electrostatic deflectors with phase-locked radiofrequency voltages. With proper amplitude and phase control chopper assemblies are described that do not add significant energy spreads to the beam.

6 Claims, 2 Drawing Sheets

COMBINATIONS OF DEFLECTION CHOPPING SYSTEMS FOR MINIMIZING ENERGY SPREADS

CROSS REFERENCE AND RELATED APPLICATIONS

This application claims priority to U.S. provisional patent application Ser. No. 60/480,862 filed Jun. 24, 2003 entitled "Multiple Deflection Chopping System For Use In Subnanosecond Bunching Systems" the disclosure of which is incorporated herein by reference in its entirety.

FIELD OF THE INVENTION

The disclosed methods and apparatus relate generally to the construction and use of electrostatic chopping systems used for producing pulsed beams for time-of-flight measurements and for the injection of ions into radiofrequency accelerators.

BACKGROUND TO THE INVENTION

Applications of pulsed MeV beams are conspicuous in the field of experimental nuclear-structure research. Particularly well known is the use of pulsed beams as one component of time-of-flight methods that allow direct measurements of the velocity of neutrons and other particles. This technology also allows the selection of groups of neutrons having well-defined energy for exciting specific reactions.

During a typical velocity measurement two electronic timing pulses are generated: The first when a short burst of ions arrives at the target and the second when the reaction products produced at the target arrive at a high speed detector that is separated from the target by a known distance. Using these two pieces of timing information plus the drift distance between target and detector the velocity for a reaction product can be directly calculated. If its mass is known, the measurement provides directly the energy of reaction products.

Less well known but nevertheless important applications include: (1) By making simultaneous measurement of the velocity and energy of a reaction product a unique identification becomes available for the mass of a particle. (2) The elimination of competing radiations from other reactions when these unwanted radiations arrive at the detector at a significantly different time from that of the desired product. (3) When detectors are organized so that they only register during periods when wanted radiations are anticipated to arrive, cosmic-ray backgrounds and other non-correlated backgrounds can be reduced in the direct ratio of the on/off time of the detectors. (4) The use of very short beam bursts can allow direct measurements of nuclear lifetimes.

It should be added that a major use of pulsed ion beams is the injection of particles into radiofrequency accelerators: for particles to be captured by the acceleration fields they must arrive at a specific phase of the radiofrequency.

Apparatus commonly used for the generation of pulsed beam having pulse repetition frequencies above a few tens of kilohertz consists of a high-speed sweeper that deflects a continuous beam of ions across a suitable plate that includes an aperture near its center. Particles that do not pass through the aperture are discarded and a pulsed beam is created by the simple process of eliminating sections of the original DC beam.

It should be noted that for producing nanosecond pulse lengths the frequencies used are in the multi-megahertz range. Information can only be impressed on a beam by electromagnetic fields: mechanical chopping is not practical. Thus, to achieve the above high-speed sweeping motion a stream of ions, continuously generated by a suitable source, must be directed through a time-varying electric field that produces angular deflections of the ion beam. Such deflecting fields are generated by employing a high frequency oscillating voltage applied between a pair of parallel conducting plates between which the ion beam passes. Such a combination of deflection fields and a defining aperture is commonly referred to as a chopper, or beam-chopper system. Because the ion deflection operates in synchronism with the phase of the deflection field, the time when individual pulses leave the aperture plate is directly referenced to the phase of the radiofrequency driving voltage.

While the length of individual pulses can be decreased by increasing the writing speed of the beam across the apertured plate, the resulting reduction in pulse width can only be pushed so far: there is a lower limit of pulse length below which reduction in intensity make experimental measurements impractical. To avoid this limitation it is common practice to apply a compression technique that squeezes each pulse longitudinally. Individual pulses leaving the chopper are compressed by speeding up the trailing ions in each individual pulse so that at a prescribed distance the trailing ions catch up with the leaders causing all ions in the pulse ensemble to arrive simultaneously at the target. This technique, known as klystron bunching, uses time correlated radiofrequency fields to cause the trailing ions to travel slightly faster than the mean velocity of the burst and the leading ions slightly slower. The theory of beam bunching has been described in an article entitled 'Beam Bunching for Heavy Ions' by F. J. Lynch, et al. on page 245 of volume 159 of the journal Nuclear Instruments and Methods, (1979. For light MeV particles nanosecond, or even sub-nanosecond, pulse widths can be created.

In the explanation concerning the constraints of klystron bunching that follows it is assumed that a simple double-gap klystron buncher will be used to provide the needed time compression. While more complex bunching systems, consisting of several bunching units located serially one after each other have been reported, the simple double-gap buncher described below provides a satisfactory model.

A double-gap buncher consists of three cylindrical tubes spaced sequentially along the centerline of the ion beam. The initial and final cylinders are both at ground potential, with the central cylinder being excited by a sinusoidal radiofrequency voltage. In principle, the operating frequency of the buncher can be the same as that of the preceding chopper although a proper phase relationship must be established between the two for particle mass and energy matching. Those skilled in the art will recognize that it is often useful to operate the buncher at an integral multiple of the chopper frequency. This can have the effect of increasing the rate of change of the klystron modulating voltage; it also may be necessary to match the pulse repetition rate to experimental demands.

Applying Liouville's theorem to the operation of the buncher, it can be shown that the achievable pulse time-width at target $dt_{target}$ is fundamentally limited to:

$$dt_{target} \geq \Delta E^* T_{bunch}/E_{bunch} \quad (1)$$

Here, $\Delta E$ represents the energy spread of the particles within the ion beam when it enters the buncher. $T_{bunch}$ is the time length of the beam segment to be bunched. $E_{bunch}$ denotes the energy modulation imposed by the buncher itself.

In a practical situation, $T_{bunch}$ is chosen as large as possible, because it is directly proportional to the ion beam utilization efficiency and directly influences the fraction of the beam that is available for experimentation. The value of $E_{bunch}$ is set by the requirements for creating a time focus at a specific target location.

Equation 1 shows that the energy spread, ΔE, of the particles within the pulse directly affects the achievable pulse width at the chosen bunching location. Clearly, there are other factors beyond the scope of this document that contribute to pulse widening at the chosen bunching point, but overall buncher performance will greatly benefit from a chopper configurations that minimizes contributions to the energy spread within the pulses that leave the chopper.

The theory of the operation of choppers has been presented by J. H. Neiler and W. M. Good in an article entitled 'Time of Flight Techniques' within the book entitled Fast Neutron Physics, Volume 1 page 597, edited by J. B. Marion and J. L. Fowler (Interscience Publishers 1960). Further details of pulsed beam formation can also be found in an article presented at the Third International Conference on Electrostatic Accelerator Technology by S. J. Skorka entitled Design Considerations and Present Status of Beam Bunching Technology published by the Oak Ridge National Laboratory, TN, USA, 1981.

As stated previously, an electrostatic chopper usually consists of two parallel plates between which radiofrequency voltages can be maintained. Thus, during operation, a transverse voltage gradient (electric field) is present between the plates. While this electric field is an essential component needed to produce been sweeping the transverse voltage from which this field is derived has a deleterious effect on the energy spread of ions within each pulse. Such energy spread is introduced because the radial dimension of the ion beam tends to be large within the deflection region. The reason for the large dimension is that to produce well-defined pulses it is desirable that the beam be focused to a narrow waist to pass quickly across the small diameter defining aperture. Those skilled in the art will recognize that this focusing constraint, together with the inevitable finite emittance of the ion beam leaving the source, automatically results in a finite beam width within the fields of the chopper. As a consequence, when ions enter the field region between the parallel plates on one side of beam centerline the ions are accelerated and on the opposing side of the centerline they are decelerated.

At first sight it might appear that these energy spreads introduced during entry to the chopper field would be removed when the ions left the deflection region. This would be true if square waves could be employed for chopping but at frequencies above about a hundred kilohertz square wave deflection voltages are difficult to generate with sufficient amplitude for deflection and sinusoidal voltages derived from a high Q circuit are usually employed. The phase of the radiofrequency voltages changes during the time an ion passes through the deflection plates and, in general, full cancellation will not be possible.

These effects are quantified in the above Skorka reference where it is pointed out that because of phase angle differences between the times when the ions enter and leave the region between the chopper plates, a simple chopper system inherently introduces additional energy spread to the ion beam and that the amount of this additional energy spread can be expressed as:

$$\Delta E = \mathrm{sqrt}(2*m*E_0)*d\alpha/dt*\Delta x \quad (2)$$

Here, m and $E_0$ denotes the mass and energy of the particles, respectively, dα/dt is the time derivative of the deflection angle that is imposed on the particles by the chopper and Δx is the position of the particles within the deflector away from the centerline in the direction of the electric field between the plates of the chopper. Clearly, the introduced total energy spread depends linearly on the size of the beam that passes through the deflector.

Equation 2 can be rewritten to yield:

$$\Delta E = 4*\epsilon_0*\mathrm{sqrt}(2*m*E_0)/\Delta t \quad (3)$$

Where $\epsilon_0$ denotes the beam-emittance from the ion source and Δt is the duration of the beam pulses produced by beam passage across said aperture.

Although those skilled in the art will recognize that some approximations have been made in the derivation of equation 2, in most practical situations the results are valid and useful for showing the manner in which specific parameters influence the final energy spread of the beam. In a typical situation the introduced energy spread, ΔE, can have a magnitude of several tens to hundreds of electron volts and usually overwhelms the energy spreads that originate within the ion source itself (~1–10 eV).

The present invention relates to a chopping system comprising at least two electrostatic deflectors located sequentially along the beam path and excited using phase-locked radiofrequency voltages. Using correct relative phasing and amplitudes this combination does not add significantly to energy spreads originating from the ion source. As a result, the time compression that can be achieved by the buncher is improved and ion beams having lower energy can be more effectively time-compressed.

BRIEF DESCRIPTION OF THE DRAWINGS

The invention may best be understood from the following detailed description, thereof, having reference to the drawings in which.

DETAILED DESCRIPTION

Figure 1:
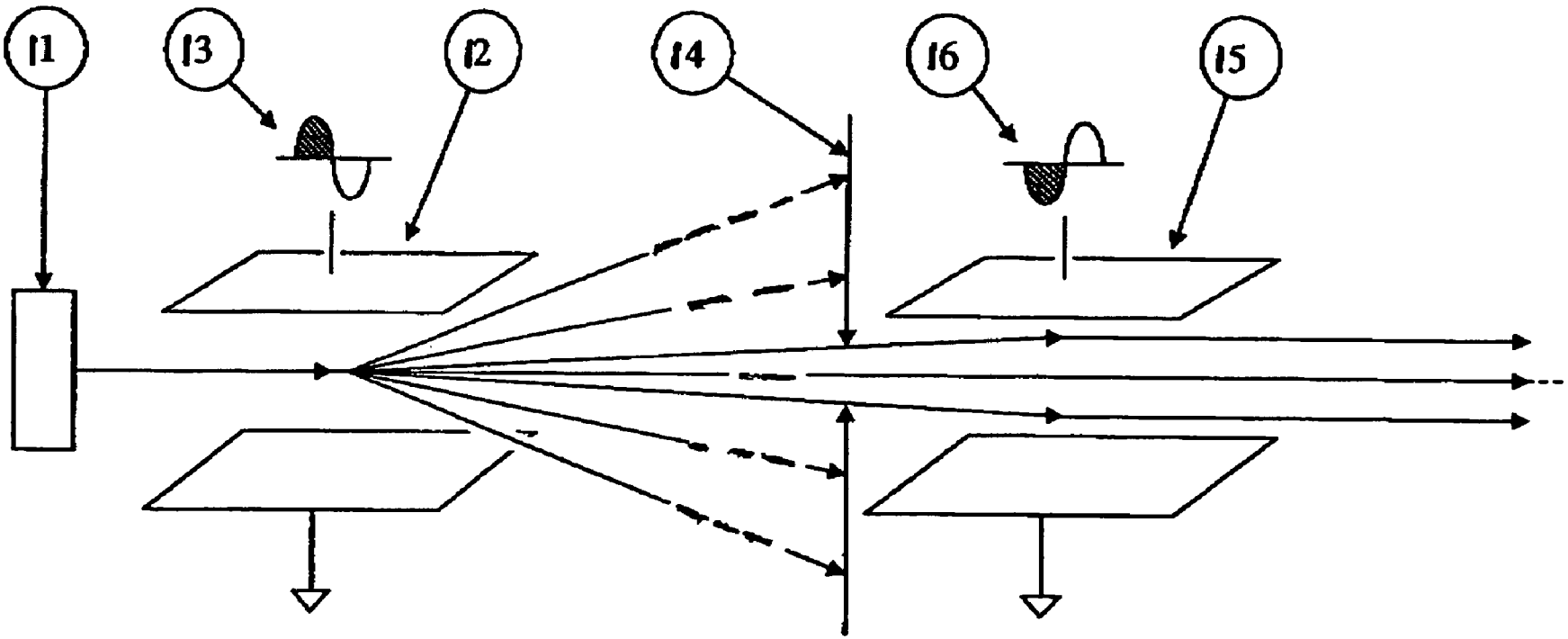
FIG. 1 is a schematic diagram that shows a compensating chopping arrangement using a single energy-correction unit.

FIG. 1 presents the preferred embodiment. The first of two deflector units, 12 and 15, is located along the beam path. The chopper, 12, serves to scan the beam leaving ion source, 11, across an aperture plate, 14. Following this plate is located an additional deflector unit, 15. The phase and amplitude of the signals, 16, applied to this second deflector, 15 are adjusted in a manner such that the second deflector, 15, generates an energy modulation of the individual particles, according to equation 2, but with an appropriate phase and amplitude that will cancel the energy spread introduced by the primary chopper, 12. The overall energy spread imposed on the beam by the pair of deflector units, 2 and 5 can be adjusted to be close to zero.

Referring again to FIG. 1, it can be seen that the first deflector, 12, is excited using a high-voltage radiofrequency whose waveform, 13, is sinusoidal. The effect is to introduce a time-dependent deflection angle to the beam leaving the ion source, 11, producing a time-dependent pattern where the ion beam strikes the apertured plate, 14, which may be a linear trace or an elliptical pattern. The accepted particles pass through the hole in the center of the plate, 14. (Those skilled in the art will recognize that it is frequently advantageous to introduce a small component of the deflection fields at right angles to the main deflecting field at a radiofrequency phase that is 90° advanced or retarded. Thus, the scanning pattern on plate 14 becomes an ellipse rather than a straight line. The reason for this is to produce only one pulse per cycle of the radiofrequency driver.)

It can be seen that an additional deflector unit, 15, located just after said aperture in the plate, 14, is excited with a radiofrequency voltage, 16, that operates at the same frequency and with comparable amplitude as that used in the chopper, 12. It will be apparent to those skilled in the art that the phase difference between the primary and second deflector unit, 12 and 15, will be dependent upon the travel time of the particles between units 12 and 14 (i.e. upon the ion mass, energy and distance between the center of the units) plus an additional 180 degrees of phase shift that must be added to cancel the time dependent energy spread that were introduced by the first unit, 12.

Referring again to FIG. 1, it will be apparent that the central trajectory of the ion beam that emerges from the additional deflector unit 15 does not include angles that vary with time, measured with respect the central axis. However, it should be pointed out that that the transverse location of an individual beamlet is time dependent and its position is determined by the momentary voltages on both deflector units, 12 and 15, and the distance between them. Because of this movement the beam envelope at the exit from deflector, 15, will be effectively increased in size when the beam enters a subsequent acceleration stage. This increase in size may adversely effect the transmission of the entire beam transport system.

Figure 2:
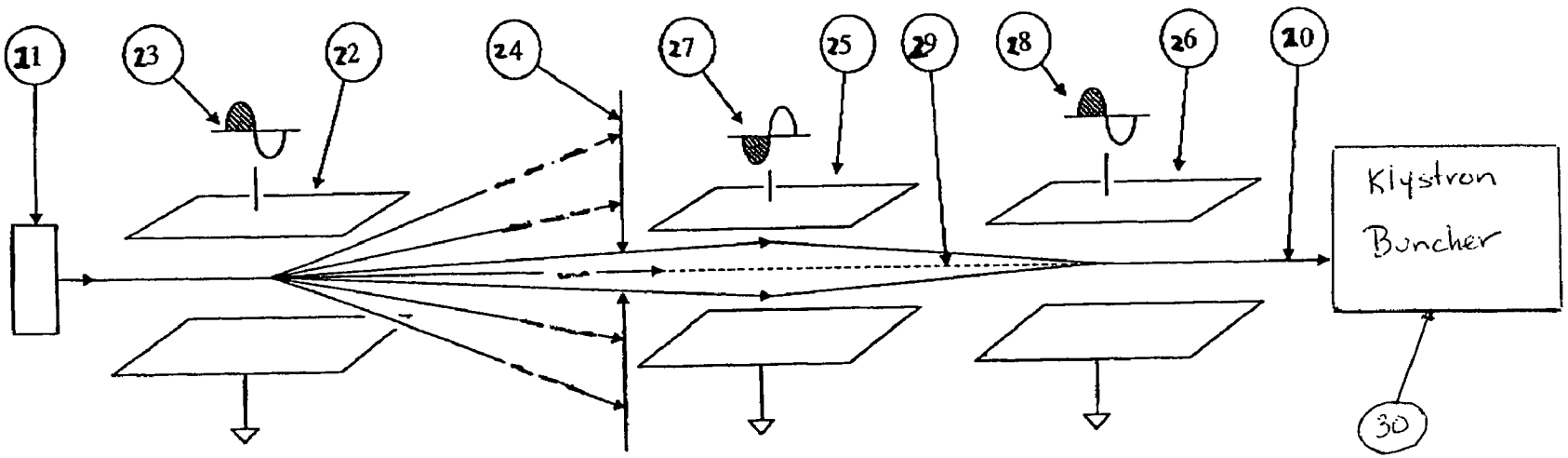
FIG. 2 is a schematic diagram showing a compensating chopping arrangement using dual energy-correction units.

FIG. 2 shows an alternative arrangement for the preferred embodiment consisting of three deflector units. Here, the primary deflector unit, 22, is again excited using a radiofrequency voltage, 23, that sweeps the beam from the ion source, 21, across an aperture plate, 24. Two additional deflector units, 25, and, 26, are placed behind the aperture and are excited with radiofrequency voltages, 27 and 28 having appropriate voltages and phases. The first additional unit, 25, deflects the beam back to the optical axis, 29, near the center position of the second additional deflector, 26. The second deflector unit, in turn, cancels the time dependent angle that is created by the primary deflector and the first additional deflector. The net result is that the beam, 20, that leaves the entire chopper system is pulsed in intensity, but is stable in position and angle. Furthermore, the entire chopper system does not contribute to the energy spread of the pulsed beam leaving the chopper; the energy spread in the beam is dominated by that of the ions on leaving the ion source. It can be seen that this preferred configuration creates a stable beam position, at the expense of some complexity of the chopper system. In some embodiments, this beam 20 is then directed through a klystron buncher 30. It will also be clear to those skilled in the art that other configurations are possible, in which the positions of the individual components can be interchanged.

What is claimed is:

1. A method for creating an energy-compensated pulsed ion beam, said method comprising at least the following steps:

creating a continuous ion beam;

deflecting said continuous ion beam by a first deflector comprising of a substantially constant-amplitude oscillating electric field and directing said deflected beam so as to produce a cyclical deflection pattern at a metallic plate that includes an aperture located downstream of said first deflector;

arranging said continuous ion beam to pass through said aperture at least once during each deflection cycle whereby an output pulsed beam is produced beyond said apertured metal plate;

passing said pulsed beam through a second deflector where said second deflector includes a substantially constant amplitude oscillating field having amplitude and phase relationship derived from the electric fields used in said first deflector and adjusting such amplitude and phase to minimize the energy inhomogeneity introduced by said first deflector; and directing said pulsed beam leaving said second deflector through a klystron buncher.

2. The method of claim 1 where a further electric field deflection is introduced for minimizing transverse motion of the pulsed beam.

3. The method of claim 2 where the oscillating electric field is sinusoidal.

4. The method of claim 1 where the oscillating electric field is sinusoidal.

5. An apparatus for creation of an energy-compensated pulsed ion beam said apparatus comprising:

an ion source adapted to create a continuous ion beam;

a first deflector comprising of a pair of substantially parallel plates between which is maintained an oscillating electric field having substantially constant amplitude, said electric field being adapted to deflect said continuous ion beam to produce a cyclical deflection pattern when said ion beam strikes a metallic apertured plate located downstream of said first deflector, means for adjusting said amplitude to produce pulsed ions of the required pulse length at locations downstream of said aperture;

a second deflector, located downstream of said aperture, comprising a pair of substantially parallel plates between which is maintained an oscillating electric field having amplitude and phase adjustable with reference to the amplitude and phase of the field within said first deflector, means for adjusting said amplitude and phase of said oscillating field within said second deflector with respect to the amplitude and phase in the first deflector to minimize energy inhomogeneity introduced by said first deflector, and a klystron buncher to time compress individual beam pulses.

6. The apparatus of claim 5 where beam motion introduced by said second deflector is reduced by directing said pulsed beam through a third deflector where said third deflector includes an oscillating field having amplitude and phase relationship to those used in both first deflector and second deflector to minimize motion introduced by said second deflector.

* * * * *